US005131209A

United States Patent [19]

Schreiber et al.

[11] Patent Number: 5,131,209

[45] Date of Patent: Jul. 21, 1992

[54] VERTICAL FOAM WRAPPING MACHINE AND METHOD FOR WRAPPING A ROLL OF CARBONLESS PAPER

[75] Inventors: Glenn Schreiber, Cecil; Rex Werth; Lonnie Iris, both of Appleton, all of Wis.

[73] Assignee: Appleton Papers Inc., Appleton, Wis.

[21] Appl. No.: 717,467

[22] Filed: Jun. 19, 1991

[51] Int. Cl.[5] ..... B65B 11/58; B65B 53/00

[52] U.S. Cl. ..... 53/399; 53/176; 53/441; 53/449; 53/556; 53/587

[58] Field of Search ..... 53/211, 399, 441, 465, 53/587, 588, 172, 176, 449, 472, 556

[56] References Cited

U.S. PATENT DOCUMENTS

| | | | |
|---|---|---|---|
| 3,589,102 | 6/1971 | Zelnick | 53/211 X |
| 4,136,501 | 1/1979 | Connolly | 53/441 X |
| 4,248,031 | 2/1981 | Del Pozo et al. . | |
| 4,314,141 | 2/1982 | Vangsted et al. . | |
| 4,409,776 | 10/1983 | Usui | 53/211 X |
| 4,468,915 | 9/1984 | Parry . | |
| 4,628,667 | 12/1986 | Humphrey e al. . | |
| 4,726,172 | 2/1988 | Widenbäck . | |
| 4,852,331 | 8/1989 | Bogh | 53/588 X |
| 4,858,415 | 8/1989 | Hake . | |
| 4,884,385 | 12/1989 | Mushinski et al. . | |
| 4,905,451 | 3/1990 | Jaconelli et al. . | |
| 4,936,459 | 6/1990 | Mushinski et al. . | |
| 5,007,538 | 4/1991 | Mushinski et al. . | |
| 5,020,300 | 6/1991 | Casteel | 53/441 X |

FOREIGN PATENT DOCUMENTS

| | | | |
|---|---|---|---|
| 0015791 | 2/1977 | Japan | 53/441 |

*Primary Examiner*—John Sipos
*Assistant Examiner*—Linda B. Johnson

[57] ABSTRACT

A vertical foam wrapping machine can rewrap rolls of carbonless paper having damaged packaging in satellite locations without the need for returning the rolls of paper to the manufacturing facility for rewrapping. The machine includes a lift device with a vertically adjustable arm. Foam wrap and stretch film are positioned on this arm and are fed to the roll of carbonless paper resting on a turntable in front of the lift device. The turntable has a rigid platform upon which the paper sits. This platform is nonmovable relative to the turntable and has a diameter less than the diameter of the roll paper. In this manner, a lower section of the roll of paper adjacent the lower edge remains exposed. As the turntable rotates, foam wrap and stretch film are wrapped around the roll of paper. Due to the exposure of the lower edge, the foam wrap and stretch film can cover this lower edge. Accordingly, both the lower and upper edges of the roll of paper can be wrapped with protective foam wrap and stretch film. If a long roll of paper is on the platofrm, the support arm can be raised or lowered to spirally wrap the roll. This machine can also be used for originally wrapping the roll of paper with foam wrap and stretch film and a hold down device can be used to lock small or light rolls of paper onto the turntable.

18 Claims, 7 Drawing Sheets

VERTICAL FOAM WRAPPING MACHINE AND METHOD FOR WRAPPING A ROLL OF CARBONLESS PAPER

BACKGROUND OF THE INVENTION

1. Field of the Invention

The present invention relates to a vertical foam wrapping machine and method for wrapping a roll of carbonless paper in foam wrap and stretch film.

2. Description of the Background Art

Various wrapping machines are known for wrapping rolls of carbonless paper in foam wrap and stretch film. However, these machines are generally complicated and expensive and intended for use in manufacturing facilities. These conventional wrapping machines are rather large, stationary, highly automated machines with a relatively high volume. Therefore, they are not usually located in distribution centers and warehousing facilities.

However, as a roll of paper moves through a distribution network, the packaging for these rolls can be damaged. For example, the foam wrap and shrink film can be torn during unloading of the roll from a truck, storage of the roll in a warehouse or in many other situations. Presently, wrapping equipment is generally kept in the manufacturing facilities and not the distribution centers or warehousing facilities for the reasons noted above.

Accordingly, when the packaging of a roll of paper is damaged after it leaves the factory, this roll must either be returned to the manufacturing facility for recycling or destroyed. Needless to say, any of these options are relatively expensive and undesirable. Since each roll can represent several thousand dollars of product, the ability to salvage a roll at the distribution site has tremendous economic advantages.

SUMMARY OF THE INVENTION

Accordingly, it is a primary object of the present invention to provide a wrapping machine and method which can easily wrap rolls of carbonless paper with foam wrap and stretch film.

It is another object of the present invention to provide a wrapping machine which can be located at distribution centers and warehousing facilities as well as a method which can be carried out at these locations.

Another object of the present invention is to provide a wrapping machine and method which can produce a package visually identical to those wrapped with the large wrapping machines found in manufacturing facilities.

It is yet another object of the present invention to provide a wrapping machine which is inexpensive to manufacture and easy to maintain.

Yet a further object of the present invention is to provide a machine and method which can rewrap or originally wrap a roll of carbonless paper in foam wrap and stretch film.

Another object of the present invention is to provide a device and a method which will expose the portion of the lower side of the roll adjacent the lower edge such that both the upper and lower edges can be wrapped with foam wrap and stretch film while the rolls are vertically oriented.

It is another object of the present invention is to provide a machine and method which do not require a lot of space, which are highly reliable and which are inexpensive.

These and other objects of the present invention are fulfilled by providing a vertical foam wrapping machine for wrapping a roll of carbonless paper in foam wrap and stretch film. The machine has a lift device with a support arm having a supply of foam wrap and a supply of stretch film thereon. This lift arm can be vertically adjusted. In front of the lift device is a turntable having a rigid platform affixed thereon. The roll of paper is generally centered on this platform with the longitudinal axis of the roll being vertically oriented. The diameter of the platform is less than the diameter of the roll such that the lower edge and a portion of the lower surface of the roll adjacent the lower edge are exposed.

Foam wrap and stretch film can be fed from the support arm to the roll of paper on the platform in this machine. Upon rotation of the turntable, the roll of paper can be encircled with foam wrap and stretch film. If the roll of paper is longer than the width of the foam wrap and stretch film, the support arm can be vertically adjusted by the lift device. In this manner, the roll of paper can be spirally wrapped with the foam wrap and stretch film.

Due to the provision of the platform holding the roll of paper a predetermined fixed distance above the turntable, both the lower and upper edges of the roll can be enclosed with foam wrap and stretch film to protect these edges. If necessary, a hold down device can be provided in order to maintain light or small rolls on the platform during rotation of the turntable.

These and other objects of the present invention are also fulfilled by a method for wrapping a roll of carbonless paper in foam wrap and stretch film. This method comprises the steps of providing a lift device and positioning a roll of foam wrap and stretch film on a support arm of the lift device. A roll of carbonless paper is then placed on a platform in front of the lift device. A longitudinal axis of the roll is vertically oriented and the lower edge of the roll sitting on the platform is exposed due to the predetermined distance between the roll of paper and the turntable. The roll of paper is held on the turntable as the turntable is rotated. Foam wrap and stretch film will be fed and wrapped around the roll of paper as the turntable rotates. After the roll of paper is encircled, the foam wrap and stretch film can be cut and the roll removed from the turntable without the need for moving the platform. In this manner, both the upper and lower edges of the roll can be protected. A package visually identical to those wrapped with larger, more expensive machines can be obtained with this instant device and method.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
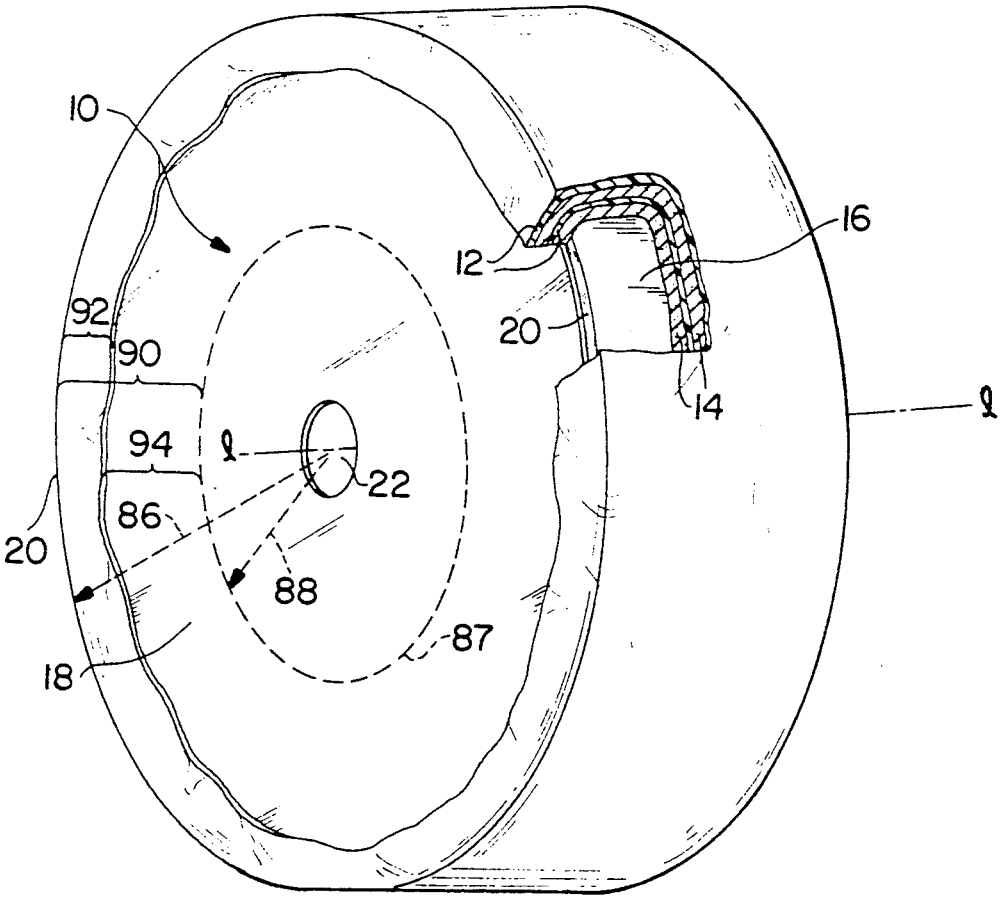
FIG. 1 is a perspective view with a partial cutaway of a roll of carbonless paper wrapped with multilayers of foam wrap and stretch film.

FIG. 1 is a perspective view of a roll of carbonless paper 10. This roll of paper 10 has stretch film 12 and foam wrap 14 encircling the sides thereof. A portion of the stretch film 12 and foam wrap 14 have been cut away in FIG. 1. The carbonless paper 16 within the stretch film and foam wrap 14 can be seen in this cutaway portion.

The roll of carbonless paper 10 in FIG. 1 is oriented such that the longitudinal axis LL is horizontal. One edge 20 of the roll of carbonless paper is indicated in this FIG. 1. It can be seen that the stretch film 12 and foam wrap 14 enclose this edge. Without provision of foam at the edge of the roll of carbonless paper, the roll will be subject to edge damage. This wrapping arrangement for the roll will protect the pressure-sensitive carbonless paper. Thus, the roll of paper 10 can easily be handled without damaging the carbonless paper 16.

In the arrangement shown in FIG. 1, two layers of foam wrap 14 and stretch film 12 are indicated. However, any number of layers of stretch film 12 and foam wrap 14 can be placed around roll 10. The stretch film 12 used in the present invention can be a film of 150 gauge to 200 gauge of either low density polyethylene (LLDPE) or polyvinyl chloride (PVC) stretch film. Additionally, any one of several polyolefin packaging foams, such as polypropylene or polyethylene having approximately a ⅛ inch thickness may be used. Any suitable foam wrap 14 or stretch film 12 can be used in the instant invention.

Shown on one end of the roll 10 of carbonless paper is an end piece 18. While it is not shown, the other side of the roll 10 of carbonless paper can have a similar end piece. Through this end piece 18 and the roll 10 of carbonless paper 16 is an opening 22.

Figure 2:
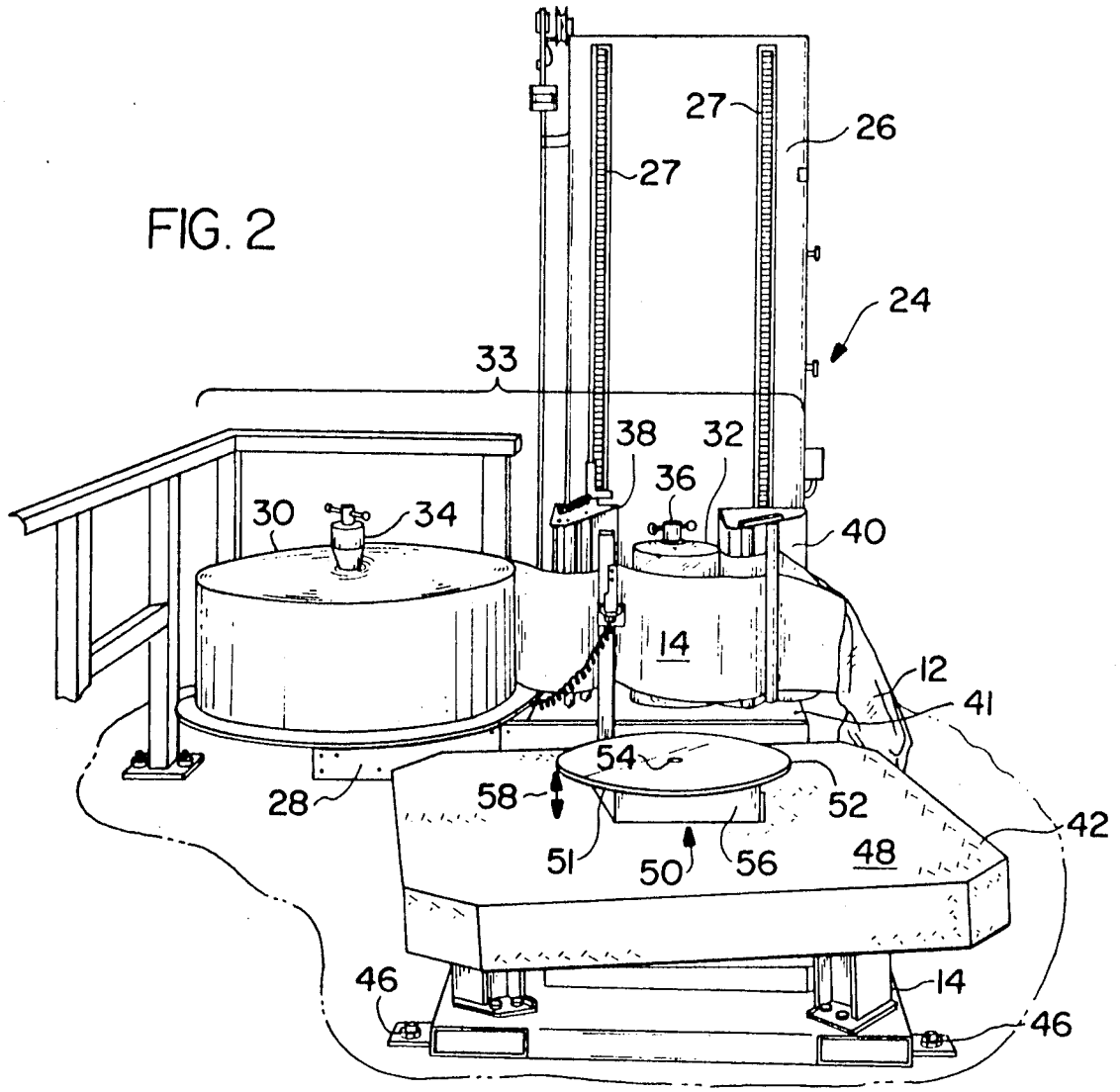
FIG. 2 is a front view of the foam wrapping machine of the present invention.

Referring now to FIG. 2, the vertical foam wrapping machine 24 of the instant invention will now be described in more detail. This machine includes a lift device 26 having a lift means 27 for raising and lower support arm 28. While a double chain arrangement 27 is shown as the lift means, it should be understood that any suitable arrangement (such as a hydraulic cylinder) can be used for raising and lowering the support arm 28.

This support arm 28 is a single, continuous arm which has means 33 for holding a supply of foam wrap and stretch film. Specifically, this means 33 includes a first spindle 34 for the foam wrap and a second spindle 36 for the stretch wrap. The roll of foam wrap 30 and roll of stretch film 32 are placed on the respective spindles 34 and 36 as indicated in FIG. 2.

Figure 3:
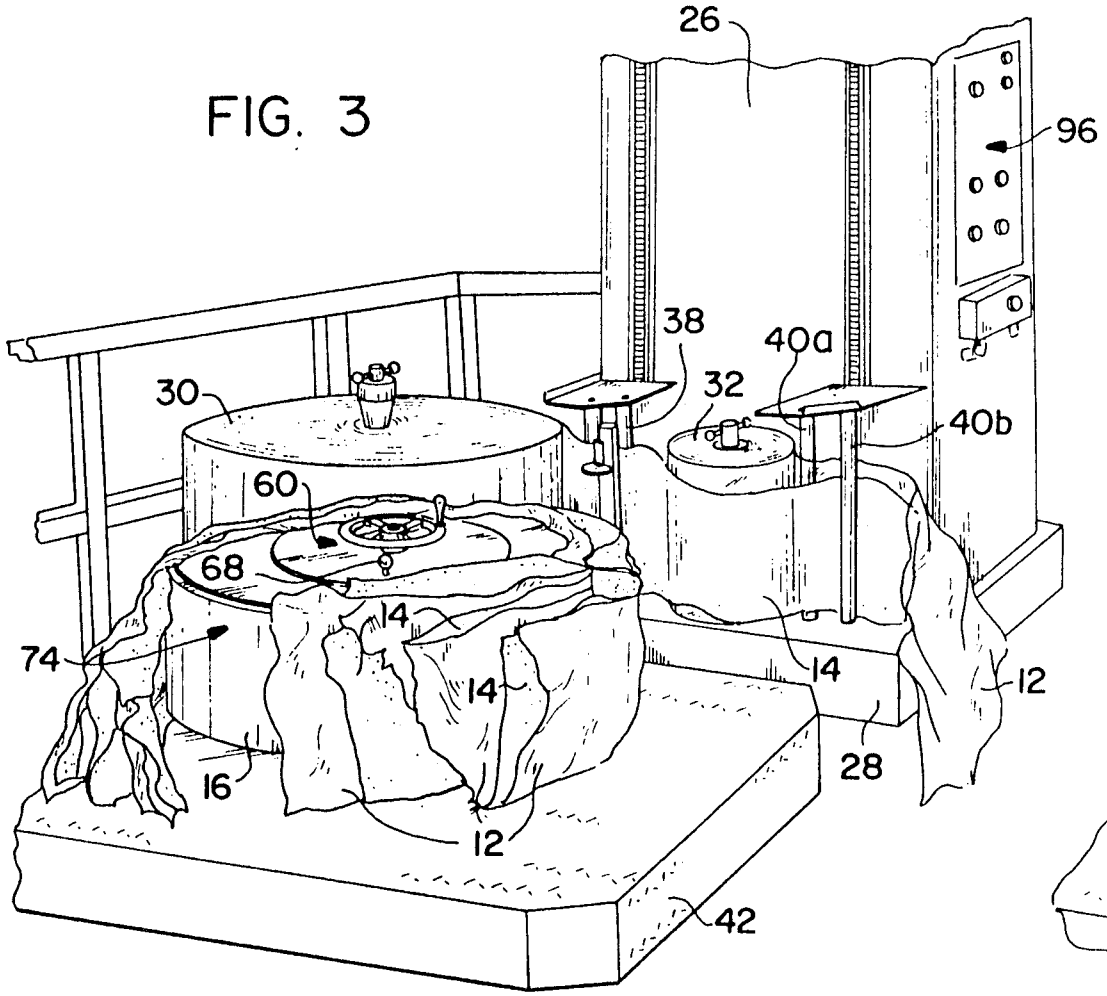
FIG. 3 is a perspective view of the foam wrapping machine of the present invention with a damaged package resting on the turntable.

The first spindle 34 is located at one end of arm 28. The foam wrap 14 will be fed from this roll past a foam wrap cutting device 38. This cutting device 38 is positioned between the first spindle 34 and second spindle 36. The foam wrap 14 can then be fed in front of the roll 32 of stretch film and through guide rollers 40. As indicated in FIG. 3, back guide rollers 40*a* and front guide rollers 40*b* can be provided. However, it should be understood that any suitable arrangement can be used for the guide rollers 40. In fact, the guide rollers 40 can be omitted and the foam wrap 14 and stretch film 12 can be fed directly to the roll 10 of paper.

The stretch film 12 is also fed through the guide rollers 40 as indicated in FIG. 2. Thus, the foam wrap 14 travels from the roll 30 past the cutting device 38, in front of the roll 32 of stretch film, through the guide rollers 40 and out an end 41 of the support arm. The stretch film 12 will move from the roll 32 past the guide rollers 40 and from the end 41 of support arm 28.

It should be recognized that the positioning of the roll 30 and 32 could be altered on the support arm 28. Also, a second cutting device can be provided on the support arm for cutting only the stretch film 12 or only one cutting device could be provided for cutting both the stretch film 12 and foam wrap 14. Either of these cutting devices could be located adjacent the end 41 of the support arm 28 such that the stretch film 12 is cut after it passes through the guide rollers 40, for example. Nonetheless, in the arrangement of FIG. 2, a cutting device 38 on support arm 28 is only provided for the foam wrap 14.

In front of the lift device 26, a rotatable turntable 42 is provided. This turntable has a fixed base 44 which is anchored at 46. The top surface 48 of turntable has a platform means 50 mounted thereon.

This platform means 50 includes a platform 51 having a top surface 52 and base 56. A port 54 is provided generally in the center of the top 52 of platform 51.

The platform means 50 is rigidly affixed to the turntable 42. This platform means 50 is nonmovable with respect to turntable 42. When a roll 10 of carbonless paper rests on this platform 51, a predetermined, fixed distance 58 is provided between the bottom of the roll 10 and the top surface 48 of turntable 42. This predetermined fixed distance 58 will enable wrapping of a lower edge of a roll of carbonless paper as will be described in more detail below.

Referring now to FIG. 3, a roll of carbonless paper with damaged packaging 74 can be placed on the platform means 50. If the roll of carbonless paper 16 is small or light, a hold down device 60 can be used in this arrangement. This hold down device 60 includes a hold down plate 62 with a crank 64 on a top surface thereof.

Figure 4:
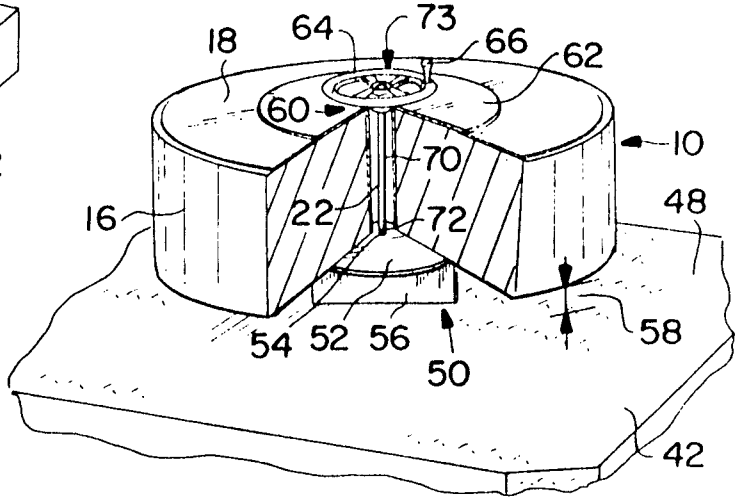
FIG. 4 is a cutaway view of a roll of carbonless paper showing the hold down device of the instant invention.

As seen in FIG. 4, this hold down plate 60 is generally centered on the roll of carbonless paper 16. A rod 70 is affixed to crank 64. This rod 70 will extend through the opening 22 in the end piece 18 and carbonless paper 16. An end 72 of the rod 70 is threaded. Within the port 54 of the platform is a mating threading engagement such that the rod 70 can be screwed into this port. A crank handle 66 is provided such that crank 64 can be rotated to screw rod 70 into port 54. A handle 68 is provided on plate 66 to aid an operator rotating crank 64. The hold down plate 62 will firmly engage the end piece 18 to hold the roll 10 on the top surface 52 of the platform means 50. It should be understood that this end piece 18 can be omitted and the hold down plate 62 would then directly engage the roll 10 of carbonless paper 16 if so desired.

By provision of this hold down device 60, a light or small roll 10 of carbonless paper can be affixed on the platform 51. As will be discussed in more detail below, the turntable 42 will rotate during wrapping or rewrapping of the roll of paper. By provision of the hold down device 60, light or small rolls of paper will not slide from the platform means 50. The hold down device 60 and mating threads in part 54 therefore act as a means for looking 73.

As can be seen in FIG. 4, the predetermined distance 58 is provided between the roll 10 of carbonless paper and the top surface 48 of platform 42. This predetermined distance does not change during wrapping or rewrapping of the roll 10 of carbonless paper.

Referring again to FIG. 3, a control panel 96 is provided on the lift device 26. This control panel can be operated in order to cause turntable 42 to rotate about a vertical axis. Also, controls on this panel 96 will enable raising and lowering of the support arm 28. Because it should be understood to one skilled in the art how the turntable 42 can be rotated and how the lift arm 28 raised and lowered, these features will not now be described in more detail. As an example, it is noted that a belt and chain drive, a direct motor engagement or any other suitable means can be used to rotate the turntable 42. Such an arrangement with the control means 96 can be thought of as the means 96 for rotating the turntable 42 of the instant invention.

Figure 5:
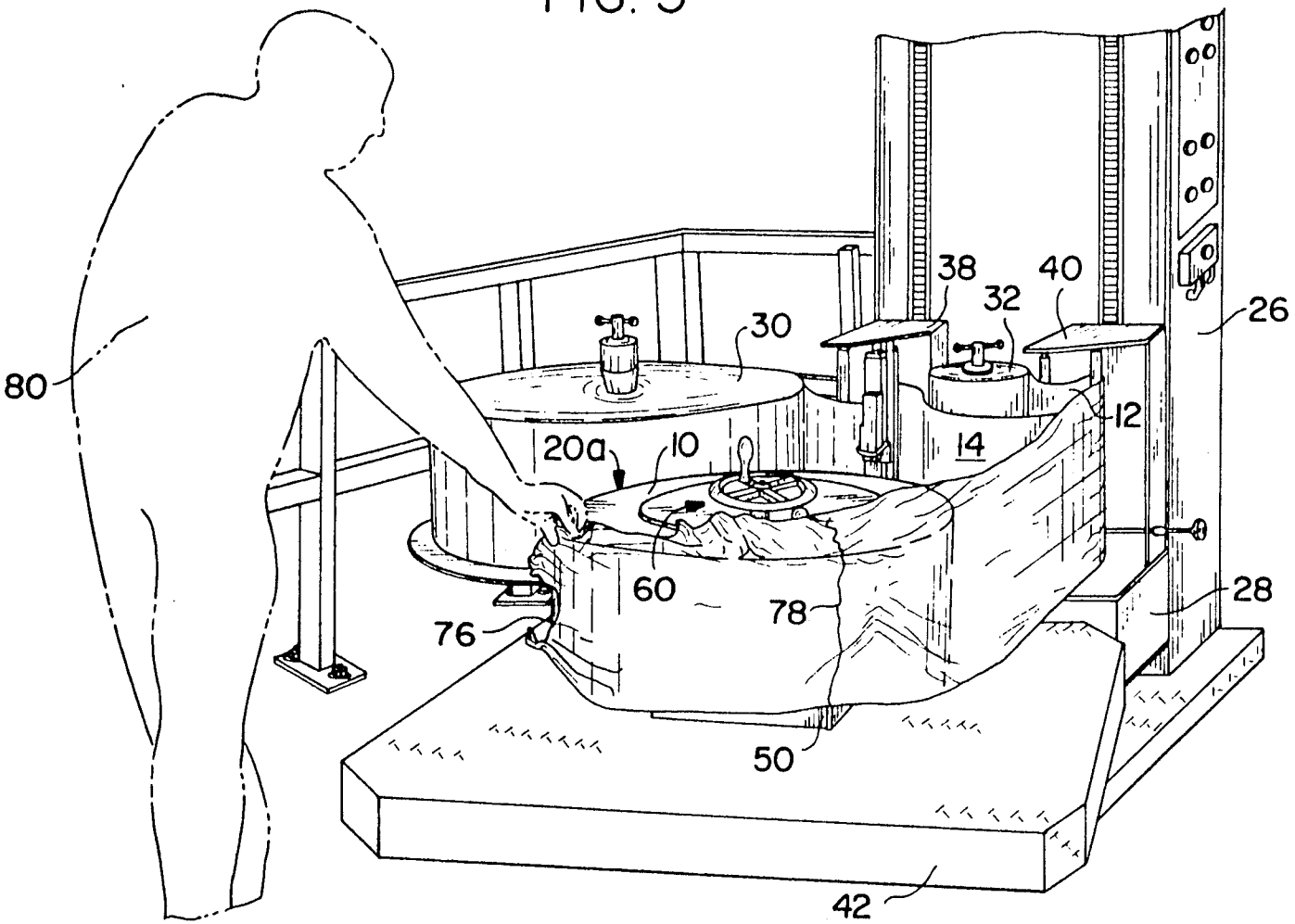
FIG. 5 is a perspective view of the foam wrapping machine of the present invention with foam wrap and stretch film being fed to the roll of paper.

Turning now to FIG. 5, the damaged packaging 74 of the roll of carbonless paper has been removed by an operator and this roll 10 has been affixed to the platform means 50 by the hold down device 60. It should be understood that if a heavy roll of paper is to be used, this hold down device 60 can be omitted. Likewise, if the turntable 42 rotates at a relatively slow speed with minimal tension from the stretch film 12 and foam wrap 14, this hold down device 60 would be unnecessary.

As indicated in FIG. 5, the foam wrap 14 and stretch film 12 can be fed from the respective rolls 32, 30 to the roll of carbonless paper 10. An operator 80 can feed this stretch film 12 and foam wrap 14 or some device can be provided for automatically feeding the stretch film 12 and film wrap 14. In FIG. 5, it is indicated that the leading edge 76 of the stretch wrap 12 is held by the operator as the turntable 42 is rotated. In this manner, tape or other adhesives can be avoided for affixing the stretch film 12 to the roll 10 of carbonless paper. Once the turntable 42 has begun rotating and a sufficient length of stretch film 12 is would around the roll 10 of carbonless paper, the stretch film 12 will naturally "stick" to the roll of carbonless paper such that the operator no longer needs to hold this film. Thus, it is not necessary that the operator 80 hold the stretch film 12 until this stretch film completely encloses the roll 10 of carbonless paper.

As indicated in FIG. 5, a slightly longer length of stretch film than foam wrap 14 is initially applied around the roll 10 as indicated by the film leading edge 76 of the film and leading edge 78 of the foam wrap. If so desired, the roll 10 of carbonless paper can be completely encircled by the stretch film 12 before foam wrap 14 is fed thereto. Alternatively, exactly the same length of foam wrap 14 and stretch film 12 could be fed to the roll 10 of carbonless paper.

Figure 6:
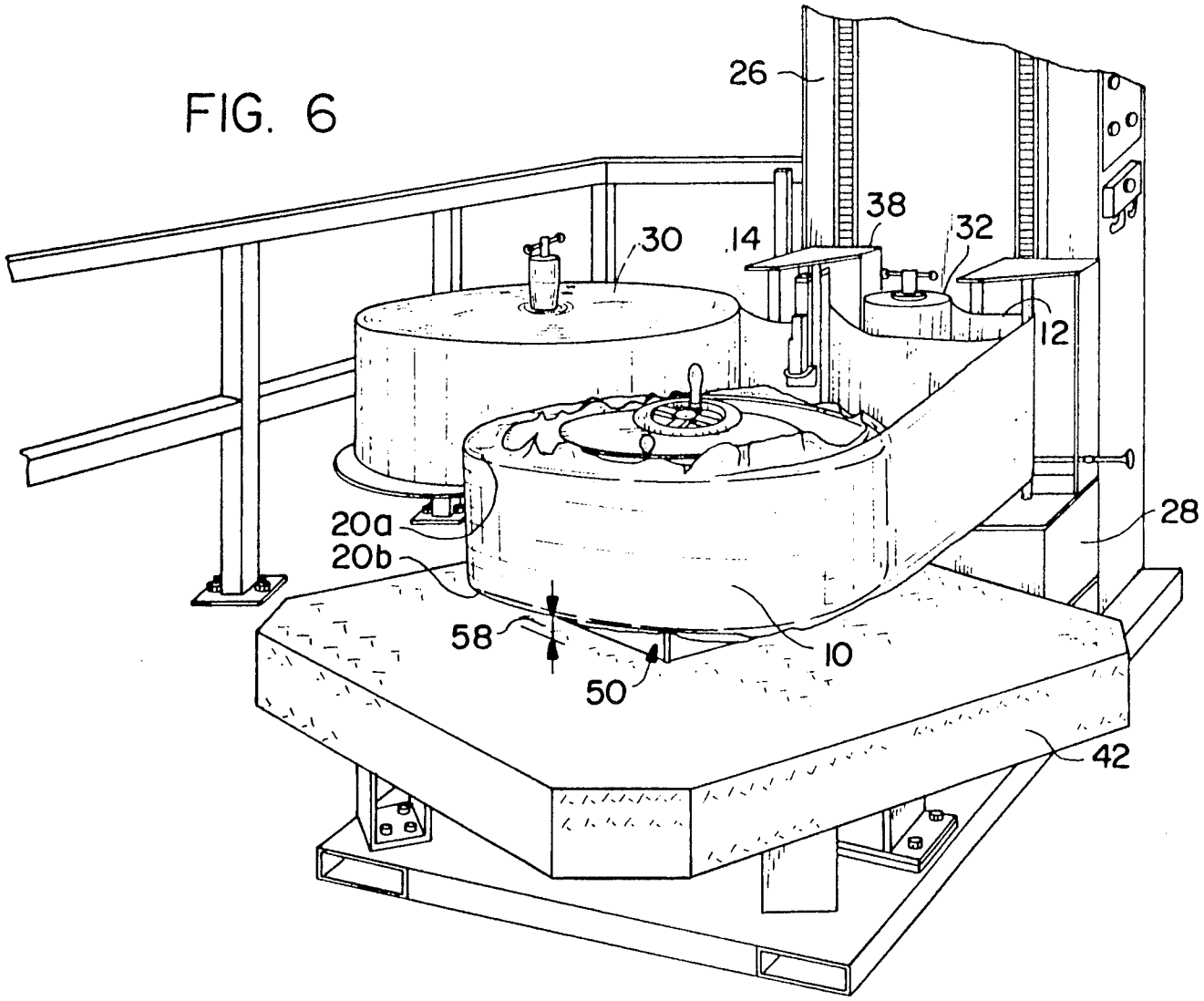
FIG. 6 is a perspective view of the foam wrapping machine of the present invention with foam wrap and stretch film being wrapped around the roll of paper.

The upper edge 20*a* of carbonless paper 16 is covered by the stretch film 12 and foam wrap 14 as seen in FIG. 6. This entire upper edge 20*a* can be completely covered by the foam wrap and stretch film. Similarly, the lower edge 20*b* can also be covered with stretch film 12 and foam wrap 14 upon rotation of turntable 42.

Returning to FIG. 1, it can be seen that the roll 10 of carbonless paper has a diameter 86. The portion of the lower edge of the roll covered by the top surface 52 of the platform means 50 is indicated by dotted lines 87 in FIG. 1. The diameter of the platform means is therefore indicated by line 88. It can be seen that the exposed portion 90 on this side of the roll extends from the diameter 88 to the edge 20 of the roll 10 of carbonless paper. A section 92 of this portion 90 is covered by the stretch film 12 and foam wrap 14. The remainder 94 of this exposed portion is not covered by the stretch film 12 and foam wrap 14. The exact dimensions for the covered section 92 and remainder section 94 can vary. In fact, the foam wrap 14 and stretch film 12 can be fed up to the edge 87 of the top surface of the platform means 50.

Returning now to FIG. 6, the roll 10 of carbonless paper can be wrapped a desired number of times by the foam wrap 14 and stretch film 12. For example, three layers of foam wrap can be provided around the roll 10. Due to the provision of the platform means 50 having the predetermined distance 58 between the roll 10 and the turntable 42, the lower edge 20*b* of the roll can receive both the stretch film 12 and foam wrap 14. Also, the diameter of the hold down device is such that the upper edge 28 of the roll 10 of carbonless paper can receive both the stretch film 12 and foam wrap 14 without interference.

After the roll 10 is wrapped a sufficient number of times, the cutting device 38 can be actuated to cut the foam wrap 14. The turntable 42 can continue to rotate, if so desired, such that additional stretch film 12 is fed from roll 32 around the roll 10 of carbonless paper. After the desired amount of stretch film 12 is applied to the roll of carbonless paper, this stretch film 32 can be manually cut. As noted above, a separate cutting device could also be provided on the support arm 28 for the stretch film 12. By provision of this instant vertical foam wrapping machine, a foam wrap package can be provided which will protect the edges of the pressure-sensitive carbonless paper. This rewrapped or originally wrapped roll can easily be removed from the platform 51 without the need to adjust or otherwise move this platform. Also, hold down device 60 can quickly and easily be removed from the roll without interference to the new packaging on the roll. The finished package is free of wrinkles, bagging and waffling and has a smooth type overlap around the edges.

Figure 7:
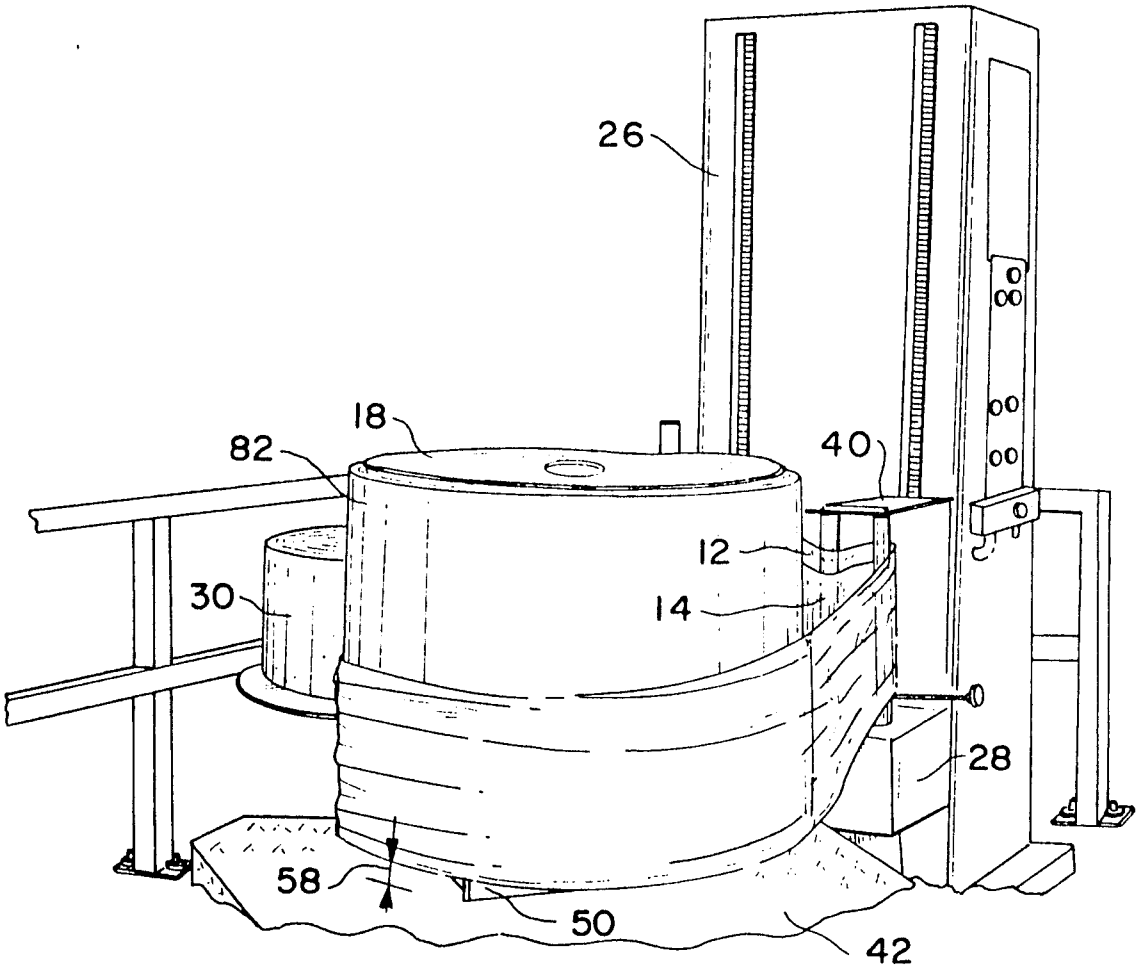
FIG. 7 is a perspective front view of the foam wrapping machine of the present invention with a larger roll of paper on the turntable.

Referring now to FIG. 7, a larger roll 82 of carbonless paper is seen. This roll 82 has a length greater than the width of the stretch film 12 and foam wrap 14. Due to the size of this larger roll, the hold down device 60 can be omitted. However, if necessary, it should be understood that a hold down device 60 could also be used with larger rolls 82. It would merely be necessary to provide a rod 70 for the hold down device which has a sufficient length to extend through the roll of carbonless paper to the port 54 of the platform.

Similarly with the smaller rolls of paper, the larger roll 82 is spaced a predetermined distance 58 from the turntable 42 by the platform means 50. In this manner, the lower edge of the larger roll 82 can also be enclosed with stretch film 12 and foam wrap 14.

Initiation of feeding of the stretch 12 and foam wrap 14 can manually be carried out similarly to the smaller roll. The turntable 42 can be rotated in order to enclose the larger roll 82 in stretch film 12 and foam wrap 14. After the lower edge of this larger roll 82 has at least been completely closed once by the foam wrap 14 and stretch film 12, the support arm 28 can be vertically raised by the lift device 26. The turntable 42 will continue to rotate. In this manner, the larger roll 82 can spirally be wrapped with stretch film 12 and foam wrap 14.

Figure 8:
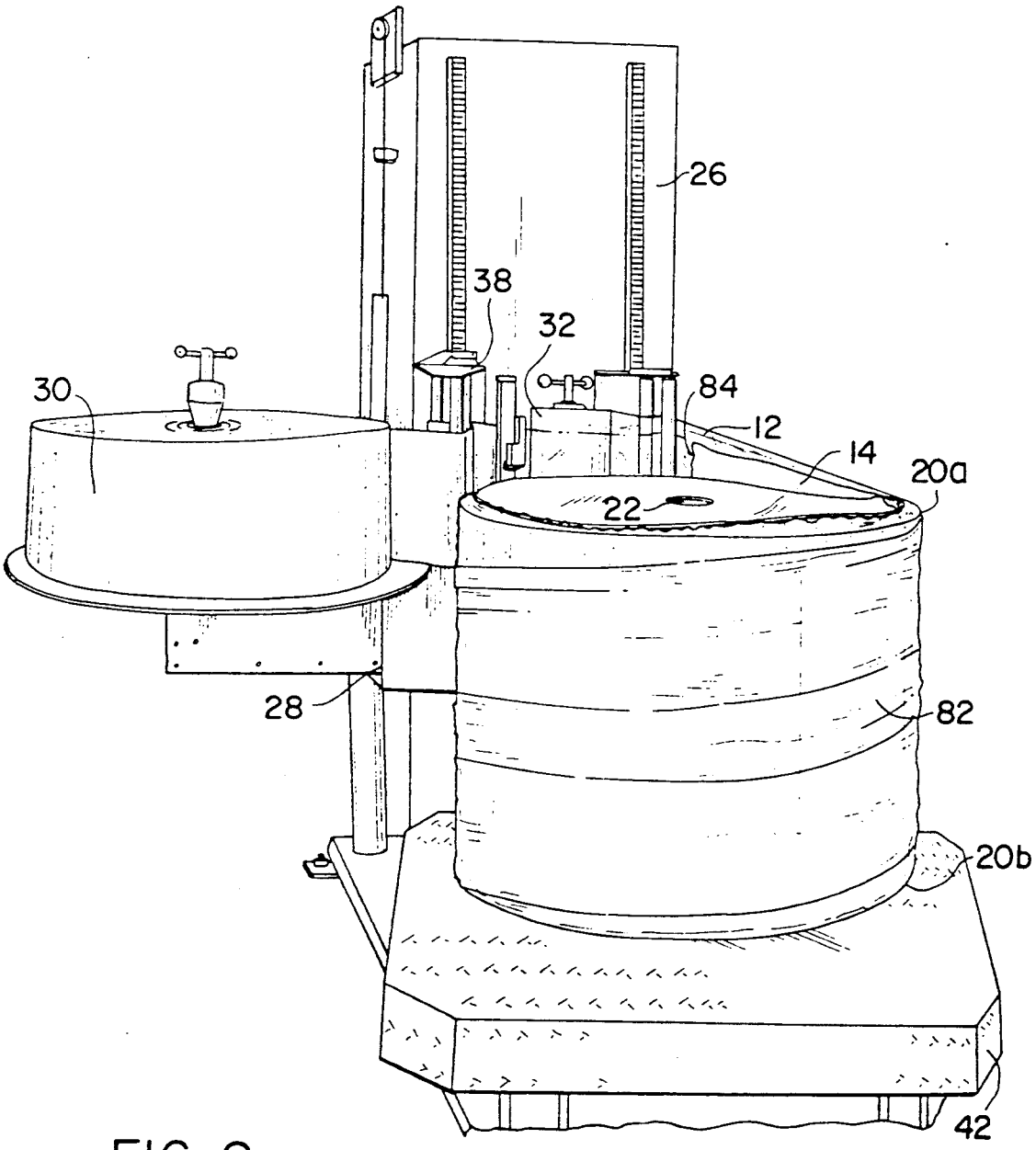
FIG. 8 is a perspective view of the present invention with a larger roll of paper on the turntable and after cutting of the foam wrap.

As indicated in FIG. 8, the cutting device 38 is actuated in order to cut the foam wrap 14 at 84 so that this foam wrap 14 will encircle the upper edge 20*a*. The turntable 42 can continue to rotate while the support arm 28 is lowered by the lift device 26. In this manner, only stretch film 12 will then be spirally wrapped around the large roll 82. When this large roll 82 has again been completely wrapped by the stretch film 12, this stretch film 12 can be cut. A finished package is then provided.

Because the section of the smaller roll 10 or larger roll 82 having the stretch film 12 and foam wrap 14 does not extend beyond the radius 88 of the top 52 of the platform means 50, the finished roll can be easily removed from the turntable 42. The platform means 50 will remain rigidly affixed to the turntable 42. In this manner, a complicated and expensive device for enclosing the lower edge of the roll of carbonless paper is avoided. This relative simple platform means 50 is not subject to a lot of maintenance, is not expensive to manufacture and can be readily incorporated into existing turntable arrangements.

In the vertical foam wrapping machine 24 of the present invention, a method for wrapping the roll 10 or 82 of carbonless paper is provided In this method, the lift device 26 is provided with the vertically adjustable support arm 28. The roll 10 or 82 of carbonless paper is placed on the platform 51 such that the axis LL of the roll is vertically oriented. The roll of paper will then be held on the platform 51 with the lower edge 20*b* being exposed. Foam wrap 14 and stretch film 12 can be fed from the rolls 30 and 32 while turntable 42 is rotated. In this manner, the roll 10 or 82 can be encircled with foam wrap 14 and stretch film 12. By enclosing the lower edge 20*b* of the roll with stretch film 12 and foam wrap 14, this lower edge 20*b* will be protected. After the roll 10 or 82 is encircled with stretch film 12 and foam wrap 14, both the stretch film 12 and foam wrap 14 can eventually be cut. Throughout this process, the predetermined distance 58 between the roll of paper and the turntable 42 is maintained. The roll of paper 10 or 82 is then removed from the turntable 42 without the need for moving or adjusting the platform 51.

The vertical foam wrapping machine and method of the instant invention are relatively simple and inexpensive to operate. Rolls of carbonless paper having torn packaging can be easily rewrapped or previously unwrapped rolls of carbonless paper can be wrapped for the first time. In either arrangement, the roll will have a package visually identical to those rolls wrapped on more complicated and expensive devices.

The instant wrapping machine and method can be carried out in satellite locations such as distribution centers and warehousing facilities. In this manner, the need to return torn packages to the manufacturing facility or to scrap these torn packages is avoided. Because each roll represents a substantial investment, the salvaging of these rolls has tremendous economic advantages. In the instant machine and method, rolls of various diameters or lengths can easily be wrapped The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A vertical foam wrapping machine for wrapping a roll of carbonless paper in foam wrap and stretch film, the roll of paper having a longitudinal axis and the machine comprising:

a lift device having a support arm, the support arm being vertically adjustable by the lift device;

means on the support arm for holding a supply of foam wrap and a supply of stretch film;

a turntable positioned adjacent the lift device, the turntable having a top surface and being rotatable about a vertical axis;

platform means for receiving the roll of paper, for holding the roll of paper above the top surface of the turntable at a fixed predetermined distance and for exposing a portion of a lower side of the roll of paper adjacent a lower edge thereof, said platform means comprising a rigid platform mounted on the top surface of the turntable, the roll of paper being generally centered on the platform and the longitudinal axis of the roll of paper being vertically oriented when the roll is resting on the platform, the platform being nonmovable with respect to the turntable whereby the roll of paper is held above the turntable at the fixed predetermined distance and a diameter of the platform being less than a diameter of the roll of paper whereby the portion of the lower side of the roll extends beyond the platform and is thereby exposed; and means for rotating the turntable, the roll of paper on the platform being rotated by rotation of the turntable whereby foam wrap and stretch film can be fed from the means for holding and wound around the roll of carbonless paper, a section of the portion of the lower side of the roll being coverable with foam wrap and stretch film due to the portion of the lower side being exposed by the platform means.

2. The vertical foam wrapping machine as recited in claim 1, wherein the support arm is a single, continuous arm with the means for holding being mounted on an upper side thereof, the means for holding comprising a first spindle for holding a roll of the foam wrap and a second spindle for holding a roll of the stretch film.

3. The vertical foam wrapping machine as recited in claim 2, further comprising means for cutting at least one of foam wrap and stretch film from the respective roll of foam wrap and stretch film, the means for cutting being located on the support arm.

4. The vertical foam wrapping machine as recited in claim 3, wherein the means for cutting only cuts the foam wrap, the first spindle being located toward one end of the support arm and the means for cutting being located between the first and second spindles, the other end of the support arm being in a direction from which the foam wrap and stretch film are fed.

5. The vertical foam wrapping machine as recited in claim 4, further comprising rollers located at the other end of the support arm, said rollers guiding the foam wrap and stretch film fed from the roll of foam wrap and the roll of stretch film, the rollers each having a vertical longitudinal axis.

6. The vertical foam wrapping machine as recited in claim 4, wherein the turntable is positioned in front of the second spindle and wherein the foam wrap is fed from the roll of foam wrap, past the means for cutting in front of the second spindle, from the other end of the support arm and to a side of the roll of paper and wherein the stretch film is fed from the roll of stretch film from said other end of the support arm and to the side of the roll of paper wherein the foam wrap is generally positioned interiorly of the stretch wrap on the roll of carbonless paper and wound around the roll of paper upon rotation of the turntable by the means for rotating.

7. The vertical foam wrapping machine as recited in claim 6, further comprising lift means for vertically adjusting said support arm to thereby raise and lower the roll of foam wrap and the roll of stretch film, the roll of carbonless paper being spirally wrapped in foam wrap and stretch film upon rotation of the turntable by the means for rotating and upon vertical adjustment of the support arm by the lift means.

8. The vertical foam wrapping machine as recited in claim 1, further comprising lift means for vertically adjusting said support arm to thereby raise and lower the means for holding, the roll of carbonless paper being spirally wrapped in foam wrap and stretch film upon rotation of the turntable by the means for rotating and upon vertical adjustment of the support arm by the lift means.

9. The vertical foam wrapping machine as recited in claim 8, wherein the means for rotating rotates the turntable and the lift means raises the support arm such that an upper section of the roll of paper adjacent an upper edge thereof is coverable with the foam wrap and the stretch film whereby both the lower edge and the upper edge of the roll of carbonless paper are protected by the foam wrap and the stretch film

10. The vertical foam wrapping machine as recited in claim 1, wherein the means for rotating rotates the turntable such that an upper section of the roll of paper adjacent an upper edge thereof is coverable with the foam wrap and the stretch film whereby both the lower edge and the upper edge of the roll of carbonless paper is protected by the foam wrap and the stretch film.

11. The vertical foam wrapping machine as recited in claim wherein the platform comprises a generally circular plate upon which the roll of carbonless paper rest and a rigid base positioned between the plate and the turntable, the base being nonmovably mounted to the turntable.

12. The vertical foam wrapping machine as recited in claim 1, wherein the platform has a central port defined therein, the machine further comprising a hold down device, the hold down device including a hold down plate which rests on the top of the roll of carbonless paper over an opening defined therein, the longitudinal axis of the roll of paper passing through the opening, the hold down device further comprising a rod insertable through the opening of the roll of paper and into the central port of the platform and comprising means for locking an end of the rod into the central port and pressing the hold down plate against the roll of paper whereby the roll of paper is securely held on the platform.

13. The vertical foam wrapping machine as recited in claim 12, wherein the port of the platform has a threaded portion therein and wherein the means for locking comprises a mating threaded portion at the end of the rod for screwing the rod into the port and wherein the means for locking also comprises a crank for rotating the rod to screw the end of the rod into the port of the platform.

14. A method for wrapping a roll of carbonless paper in foam wrap and stretch film, the method comprising the steps of:

a) providing a lift device having a vertically adjustable support arm;

b) positioning both a roll of foam wrap and a roll of stretch film on the support arm;

c) placing a roll of carbonless paper on a platform of a turntable located in front of the lift device, the roll having a longitudinal axis which is vertically oriented when the roll is on the platform and the roll having an upper side and lower side with a respective upper edge and lower edge, the platform being fixed with respect to the turntable;

d) holding the roll of paper above the turntable by the platform at a fixed predetermined distance;

e) exposing a portion of the lower side of the roll of paper adjacent the lower edge while the roll of paper is on the platform;

f) feeding foam wrap from the roll of foam wrap and stretch film from the roll of stretch film to the roll of paper on the platform;

g) rotating the turntable with the roll of paper;

h) encircling the roll of paper with the foam wrap and the stretch film during the sep of rotating of the turntable;

i) protecting the lower edge of the roll of paper by wrapping a section of the exposed portion of the lower side with foam wrap and stretch film, the step of holding enabling the section of the lower side of the roll of paper to be wrapped;

j) cutting the foam wrap and stretch film encircling the roll of paper from the roll of foam wrap and the roll of stretch film;

k) maintaining the predetermined distance of the roll of paper from the turntable throughout the steps d-i; and l) removing the roll of paper wrapped in foam wrap and stretch film from the turntable without moving the platform such that the platform remains rigidly affixed to the turntable.

15. The method as recited in claim 14, further comprising the step of protecting the upper edge of the roll of paper by wrapping a section of the upper side with foam wrap and stretch film, both the lower edge and upper edge of the roll of paper thereby being covered by the foam wrap and stretch film.

16. The method as recited in claim 14, further comprising the steps of:

vertically adjusting the support arm to raise or lower the rolls of foam wrap and stretch film; and spirally wrapping the roll of paper with at least one of foam wrap and stretch film during the step of vertically adjusting and during the step of rotating the turntable.

17. The method as recited in claim 16, wherein the step of spirally wrapping includes the steps of raising the support arm while rotating the turntable to wrap both foam wrap and stretch film spirally around the roll of paper whereafter the step of cutting cuts only the foam wrap and then the support arm is lowered to wrap only stretch film spirally around the roll of paper and then the stretch wrap is cut to provide a roll of wrapped carbonless paper.

18. The method as recited in claim 14, further including the step of removing damaged wrap from the roll of carbonless paper after the step of placing the roll of paper on the platform.

* * * * *